US008474644B1

(12) United States Patent
Morris, Jr.

(10) Patent No.: US 8,474,644 B1
(45) Date of Patent: Jul. 2, 2013

(54) TAMPER INDICATOR FOR USE WITH PAILS

(76) Inventor: Glenn H. Morris, Jr., Chattanooga, TN (US)

( * ) Notice: Subject to any disclaimer, the term of this patent is extended or adjusted under 35 U.S.C. 154(b) by 0 days.

(21) Appl. No.: 13/351,796

(22) Filed: Jan. 17, 2012

Related U.S. Application Data

(63) Continuation-in-part of application No. 12/814,537, filed on Jun. 14, 2010.

(51) Int. Cl.
*B65D 41/06* (2006.01)

(52) U.S. Cl.
USPC ..... 220/288

(58) Field of Classification Search
USPC ..... 215/216, 330, 331; 220/326, 288
See application file for complete search history.

(56) References Cited

U.S. PATENT DOCUMENTS

| | | | | | |
|---|---|---|---|---|---|
| 3,881,623 | A * | 5/1975 | Landen | 215/216 |
| 4,512,484 | A * | 4/1985 | Mar | 215/221 |
| 4,732,288 | A * | 3/1988 | Morris, Sr. | 215/214 |
| 4,967,926 | A * | 11/1990 | Morris, Sr. | 220/323 |
| 5,133,470 | A * | 7/1992 | Abrams et al. | 215/250 |
| 5,238,134 | A * | 8/1993 | Knapp | 220/266 |
| 5,265,751 | A * | 11/1993 | Lima et al. | 220/288 |
| 5,544,768 | A * | 8/1996 | Gargione | 215/209 |
| 5,692,628 | A * | 12/1997 | Montgomery et al. | 215/43 |
| 5,865,330 | A * | 2/1999 | Buono | 215/216 |
| 5,875,908 | A * | 3/1999 | Witt et al. | 215/256 |
| 5,893,475 | A * | 4/1999 | May | 215/252 |
| 6,036,036 | A * | 3/2000 | Bilani et al. | 215/216 |
| 6,044,992 | A * | 4/2000 | Ma | 215/44 |
| 6,176,381 | B1 * | 1/2001 | Mader | 215/219 |
| 6,347,716 | B1 * | 2/2002 | Nofer et al. | 215/235 |
| 6,926,165 | B2 * | 8/2005 | Conti | 220/288 |
| 7,513,384 | B2 * | 4/2009 | Morris, Sr. | 220/302 |
| 2002/0017525 | A1 * | 2/2002 | Searle et al. | 220/366.1 |
| 2005/0242055 | A1 * | 11/2005 | Oh | 215/332 |

* cited by examiner

*Primary Examiner* — Steven A. Reynolds
*Assistant Examiner* — King M Chu
(74) *Attorney, Agent, or Firm* — Stephen J. Stark; Miller & Martin PLLC

(57) ABSTRACT

An open ended container with locking lid provides the tamper indication. The lid and the container have cooperating threads. The lid has also has a locking mechanism connected to the lid, such as from a downwardly extending wall. The tamper indicator is preferably automatically deployed upon initial transition of the lid to the closed configuration but in the event of a mistake, authorized parties may remove the tamper indicator, install a new one and reset the container assembly to a set configuration.

18 Claims, 2 Drawing Sheets

TAMPER INDICATOR FOR USE WITH PAILS

CLAIM OF PRIORITY

This application is a continuation-in-part of U.S. patent application Ser. No. 12/814,537 filed Jun. 14, 2010 which is incorporated herein by reference in its entirety.

FIELD OF THE INVENTION

The present invention relates to tamper indicators for use with pails and more particularly to an improved tamper indicator such as for some embodiments, designs in which mistakes during the manufacturing process related to the filling of pails can be relatively easily corrected while still providing a tamper indication to the customer.

BACKGROUND OF THE INVENTION

Tamper proof containers have been made for a number of years. Specifically, patents such as applicant's U.S. Pat. No. 6,866,162 provide a tamper indicator for use with some pail configurations. This tamper indicator is integrally connected to a latch which is assembled to the pail lid preferably prior to filling the lid and certainly prior to shipping to the customer. However, if a mistake is discovered after adding the tamper indicator, not only will the tamper indicator need to be replaced, but also the latch. While the applicant believes this to be an excellent tamper indicator system for some uses, the tamper indicator must be installed as a separate step after filling the pail.

Plastican, a competitor with different technology, developed the technology shown in U.S. Pat. No. 6,929,165. This type tamper indicator does not require a separate step of adding a tamper indicator after the filling of a pail and installation of the lid. There is no separate step. This can be advantageous for many applications. However, if a mistake were made during the manufacture process discovered after installing the lid, there is no way to correct the problem without destroying the tamper indication feature as it is integrally provided and cannot be replaced. Once the tamper indicator feature is triggered to indicate an open pail in such a pail, it cannot be restored to the non-tampered condition again.

Accordingly, a need exists for an improved tamper indicator for use with at least some pail configurations.

SUMMARY OF THE INVENTION

It is an object of at least some embodiments of the present invention to provide an improved tamper indicator.

It is another object of at least some embodiments of the present invention to provide a tamper indicator which can be automatically set with the installation of a lid on a container, but if for some reason a tamper indicator needs to be removed by the manufacturer, a similar tamper indicator can be installed to replace the at least partially destroyed tamper indicator. The product shipped to the consumer in a set and non-tampered condition ready to identify any subsequent tampering and/or opening.

Accordingly, in accordance with a presently preferred embodiment of the present invention, a tamper indicator can be provided initially connected to a latch mechanism whereby access to and/or operation of a latch mechanism and/or opening of the lid relative to the container results in at least a partial breakage of the tamper indication system and/or possible tampering has occurred to indicate that the lid has either been opened relative to the container for at least some embodiments. In fact, in the preferred embodiment, the tamper indicator in a set configuration prevents access to the latch release. This construction can provide a tamper indicator component with the latch mechanism when the latch is installed during assembly.

However, if the manufacturer discovers that there were an error made during the filling process with product, the tamper indicator can be removed which, of course, would show the status as being tampered. But once the issue is addressed and possibly the lid reinstalled, a new tamper indicator is or can be connected to the latch mechanism and/or lid or container at an appropriate manner. The lid, if not already attached, can be reattached so that the tamper indicator is placed in the set position as the original tamper indicator was before opening the lid, ready to indicate the status of being tampered with once more. This way, a supply of tamper indicators could be provided to the manufacturer so that they could address issues at the plant such as insufficient filling of product in automated processes and/or other issues instead of destroying tamper indicators and possibly rendering container/lid systems unsatisfactory for retail sale.

BRIEF DESCRIPTION OF THE DRAWINGS

The particular features and advantages of the invention as well as other objects will become apparent from the following description taken in connection with the accompanying drawings in which.

DETAILED DESCRIPTION OF THE PREFERRED EMBODIMENT

Figure 4:
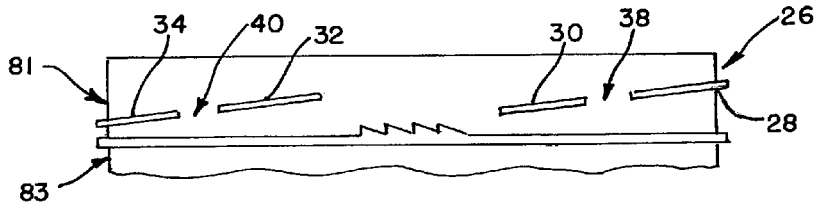
FIG. 4 is a front plan view of the container shown in FIGS. 1-3A with the lid removed.

A container 10 and lid 12 provide an assembly. The lid 12 has the capability of locking relative to the container 10. The lid 12 has a downwardly extending wall 14 with inwardly directed threads 16. The inwardly directed threads 16 are illustrated as thread segments 18, 20, 22, 24, but could be a single continuous thread in other embodiments. By providing multiple lower segments 20,24 someone installing the lid 12 relative to the container 10 may not be required to twist as far in order to have threads 16 engage outwardly directed threads of container 10 such as threads 26 shown in FIG. 4 which may similarly, or dissimilarly provided in the form of thread segments 28,30,32,34.

The multiple sets of upper segments 28,32 can provide similar capabilities, and when provided together with lower segments 20,24, a synergistic effect can be provided whereby a user can turn the lid in a first direction such as direction 36 to cooperate to tighten the lid 12 relative to the container 10 a minimal amount before at least some of threads 16 engage threads 26 as would be understood by those of ordinary skill in the art. Of course a single set of threads 26 could be employed in some embodiments. Also, although upper threads 28, 30 are anticipated to be initially engaged in the illustrated embodiment, if the gaps 38,40 are wide enough, lower thread portions 20,24 could initially engage lower portions 30,34 or other portions at least in some embodiments. It will be understood that the threads 16,26 cooperate to secure the lid 12 relative to the container 10 in a closed configuration.

Threads 26 are shown located above, at least partially above a satellite ring 82, Satellite ring 82 extends radially beyond surfaces 81 and 83 above and below the satellite ring 82 in a preferred embodiment. In fact satellite ring 82 may preferably also extend radially beyond threads 26 as well.

As the lid 12 is rotated in the first direction 36 relative to the container 10, eventually, the locking mechanism 42 can engage one or more openings 44 as will be explained in more detail if the rotation is reversed to the second direction 74. Openings 44 are shown as at least one, if not a plurality of openings 46,48 and 50 as shown in the presently preferred embodiment. Each opening 46,48 and 50 is shown having an steep first vertical surface 56 spaced from a second vertical surface 58 although some openings may take various other configurations. An angled leading surface 56 could be provided for some embodiments as well, but such a feature is not required for all embodiments.

Engagement member(s) such as member 64 has an angled leading surface 62 terminating at vertical surface 60 and can be provided as one or more teeth, such as is illustrated or otherwise. It is presently preferred that at least one of opening 44 has at least one vertical surfaces 58,60 which cooperate to lock the lid 12 relative to the container 10 in a locked configuration. It is also preferred, that at least one of opening(s) 44 and/or engagement member(s) have angled leading surfaces 62 and some may not have either or both of angled surfaces 56,62.

The leading surfaces 56,62 if angled can deflect a biased engagement member upwardly when turning the lid 10 in the closing direction, illustrated as the first direction 36. Furthermore, the leading surfaces 62 need not necessarily begin at a terminating point of a vertical surface such as vertical surfaces 58 or 60 or could be spaced apart about the opening(s) 44 as illustrated, but could in some embodiments.

The locking mechanism 42 may have a slide 66 which moves relative to a housing 68. In the illustrated embodiment, the slide moves linearly along axis 70, but other embodiments may function differently. Operator 72 is useful to move engagement member(s) 64 upwardly out of engagement with openings 44 to transition the lid 12 and container 10 combination from a locked to an unlocked configuration. Movement a predetermined distance upwardly along axis 70 moves the vertical surface 60 so that it clears one surface 58 of at least one of the opening 44 thereby allowing rotation, when attempted, in a second direction 74 which is opposite first direction 36. Front surface 59 may be angled so that as it is preferably biased out of engagement as the lid is screwed into a locking configuration and it may click as it passes over openings 44.

Spring 76 is shown in a preferred embodiment resiliently biasing the engagement member(s) 64 toward the stop(s) 44. Various spring configurations are known in the art. The illustrated spring 76 is shown between the housing 68 and the slide 66 such as by entrapment 80. Other connection systems can be utilized as are known in the art. The operator 72, if provided, can overcome the bias of the spring 76 to upwardly displace the engagement member(s) 64 as desired by the user. Retainers 52,54 and 78,80 could have barbed ends 79 for some embodiments to keep the slide from excessive downward positioning once installed. The shafts 81 could pass through openings 83 in the housing 68 during normal operation.

The locking mechanism 42 is shown connected to the downwardly extending wall 14 of the lid 12. The opening(s) 44 are shown extending into and/or through a satellite ring 82 which is illustrated below the threads 26 on the container 10. The opening(s) 44 is shown engaged from above by at least one of the engagement member(s) 64. Other connection systems can be utilized with other embodiments.

The opening(s) 44 are shown to extend radially at least as far as threads 26 in a preferred embodiment, if not radially therebeyond. Placement of the locking mechanism 42 relative to the wall 14 will have an impact on where the opening(s) 44 are located for proper engagement in the locked configuration. In the illustrated embodiment, at least a portion of the opening(s) 44 are located radially at a similar radius as the threads 26.

Figure 5:
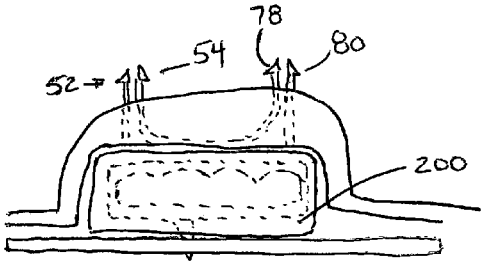
FIG. 5 is a back plan view of the container shown in FIGS. 1-3A and 4 with a tamper indicator installed.
Figure 6:
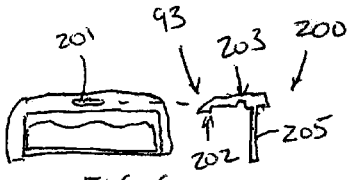
FIG. 6 is a back plan view of the container shown in FIGS. 1-3A and 4 prior to installing the tamper indicator.
Figure 7:
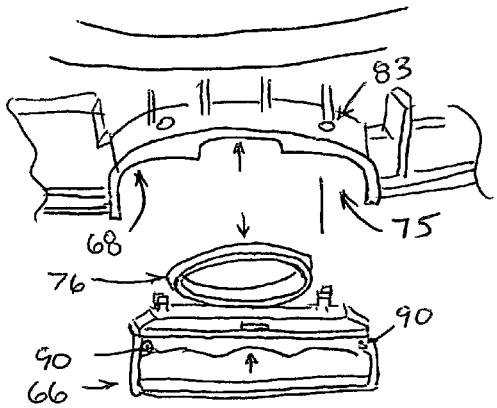
FIG. 7 is a front plan view of detail B shown in FIG. 2.

In a preferred embodiment, the locking mechanism 42 as it cooperates with the opening 44 does not provide tamper indication. However, a tamper indicator 200 shown in FIGS. 5 and 6 can be provided which may span at least a portion of cutout 75 thereby preventing easy access to the locking mechanism 42. Once the tamper indicator 200 is removed, it cannot easily be re-attached (and if it is reattached, it is relatively evident that it was previously removed). In this embodiment, if tamper indication is desired, tamper indicator 200 is shown in FIGS. 5 and 6. Tamper indicator 200 can be connected to slide 66 at bore 201 with prong 93 or other location. Specifically slide 66 is provided with a bore which receives prong 93 from back 92 of tamper indicator 200. The prong 93 may be adhered into the bore 201 or otherwise secured such as with barb 202 thereto in an effort to prevent undesired removal of the tamper indicator 200 relative to either of the lid 12 or container 10 so that once removed, reinstallation would be obvious and/or not possible as the prong would normally break at weakened point 203.

In operation, the weakened point 203 is designed to fail when subjected to force before other portions of the tamper indicator 200 would fail. Other tamper indicators 200 may function differently. With the tamper indicator 200 having its prong 93 broken off, the tamper indicator 200 then is not readily attachable back to the lid 12, container 10 or slide 66 or other portion of the locking mechanism 42. Clearly this would indicate that the potential operation of the latch locking mechanism 42 has occurred and/or opening of the lid 12 relative to the container 10 has occurred.

As opposed to prior art tamper indicators, if the manufacturer desires to remove the tamper indicator 200, such as to add more material to a particular container 10, a new tamper indicator 200 can then be installed in the bore 201 by an authorized party (such as the manufacturer's employee or other appropriate party) without needing to replace any of the lid 12, the container 10 or the locking mechanism 42, for at least preferred embodiments. The broken prong 93 from the initial or first tamper indicator 200 if it has not fallen out of bore 201, it can be relatively easily removed without a need to replace the locking mechanism 42. Furthermore, when initially providing the lid 12 of container 10, the locking mechanism 42 and/or engagement member 64 can be provided with an installed tamper indicator 200 so that operators, whether automated or human, can connect the lid 12 to the container 10 without a need for a separate step to install the tamper indicator 200 for at least some embodiments (thus automatic deployment). Of course, in other embodiments, tamper indicator 200 may be installed after installing the lid 12 to the container 10.

While the tamper indicator 200 is shown connected to the locking mechanism 42, other tamper indicators may connect directly to the lid 12 or the container 10 as would be understood by those of ordinary skill in the art.

Tamper indicator 200 which is first tamper indicator, is initially provided connected to one of the container 10, lid 12 and locking mechanism 42 at a connection such as the connection illustrated by the prong 93 cooperating with bore 201. Other connections could occur in other designs.

When transitioning the lid to an unlocked configuration from a set configuration which means the tamper indicator is ready to indicate tampering, the tamper indicator 200 is at least partially broken such as at the weakened point 203 which is just a thinner portion of the prong 92 than other portions, but other designs could have other weakened portions, the tamper indicator is at least partially broken thus indicating a tampered condition. When in a tampered condition, the tamper indicator 200 can be removed and replaced with a replacement tamper indicator 200 by authorized parties such as the manufacturer, distributor or other, but probably not a customer in most, if not all embodiments. However, there may be some exceptions. With a new tamper indicator 200, such as a second tamper indicator 200, the container assembly comprised of container can be reset to a set condition without a need to replace an engagement member 64, the locking mechanism 42, the lid 12 or the container 10.

The tamper indicator 200 can be connected to the locking mechanism 42 with a prong 93 extending through a bore to one in the locking mechanism 42. Other connections can be provided by other embodiments. The prong 93 may have a barb 202 which prevents withdrawal of the prong 93 from the bore 201 once inserted.

The weakened portion 203 is preferably located between the barb 202 and a shield 205 such as illustrated in FIG. 6 or otherwise. The shield 205 preferably blocks access to the operator such as operator 72 and/or the engagement member 62 or other portion of the locking mechanism 42 until the tamper indicator 200 is broken, such as at weakened portion 203. Other embodiments may function differently.

Figure 1:
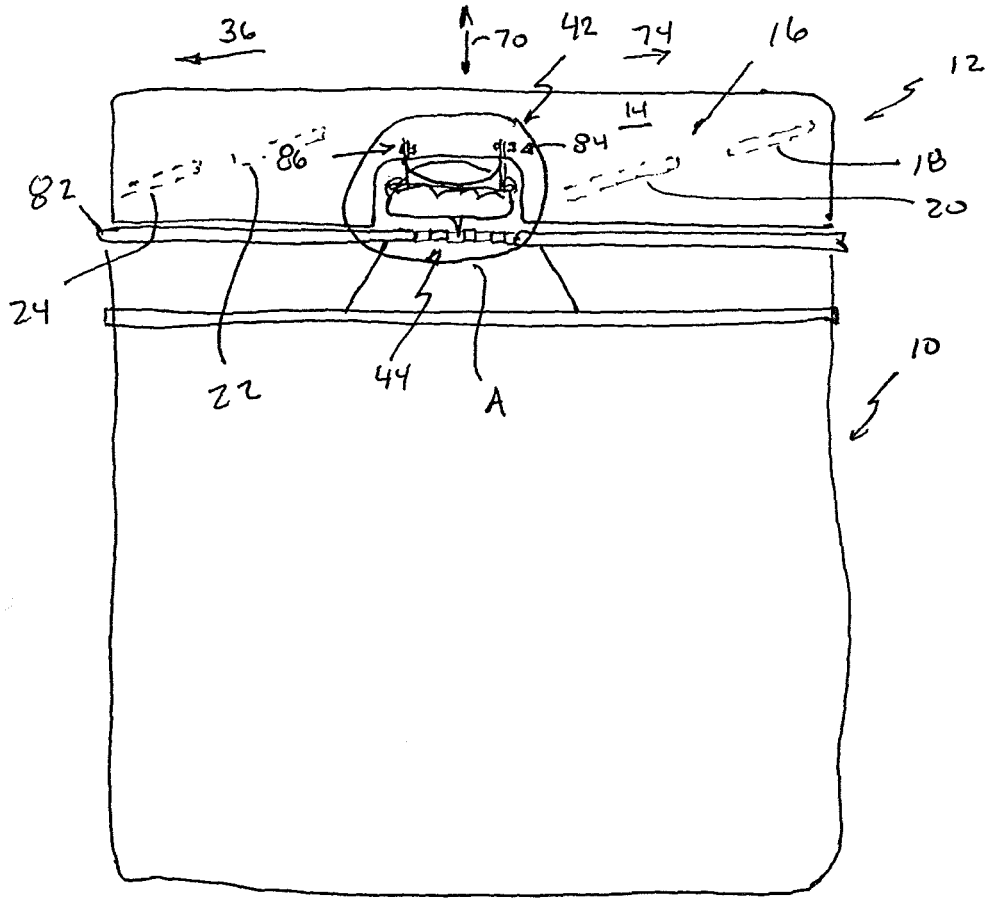
FIG. 1 is a front plan view of a lid and container system of a presently preferred embodiment of the present invention.
Figure 2:
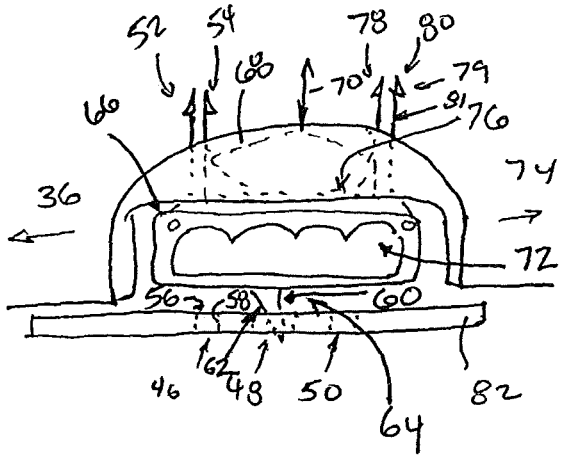
FIG. 2 is a detailed view of Detail A shown in FIG. 1.
Figure 3A:
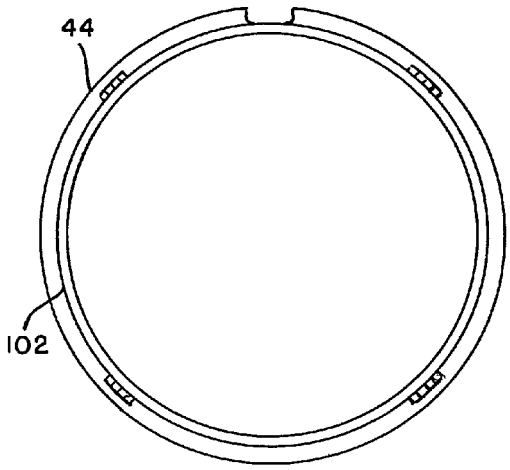
FIG. 3A is a top plan view of the container shown in FIG. 1 with the lid removed.
Figure 3B:
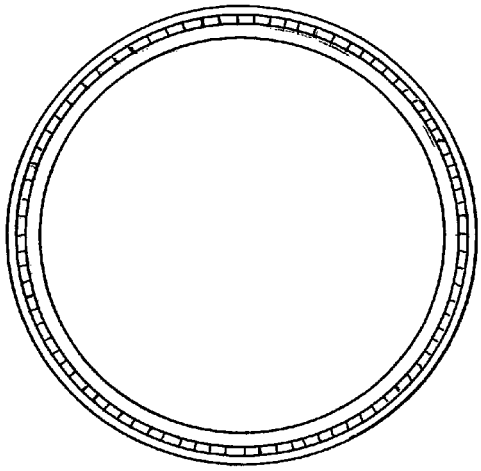
FIG. 3B is a top plan view of an alternative embodiment container as could be used with the lid shown in FIG. 1.

FIGS. 3A and 3B show possible constructions of containers. FIG. 3A shows four sets of openings 44 disposed about the satellite ring 82 of the container 10. A series of openings 44 are separated by planar upper surface 102 between adjacent sets of openings 44. FIG. 3B shows openings 44 at least substantially circumnavigating the satellite ring 82. Other embodiments may not provide openings 44 on satellite rings, but instead locate one or more opening(s) 44 at various desired locations relative to the container 10.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A container assembly comprising:

a container having an open end and outwardly directed threads extending from an outer exterior wall surface of the container, and at least one opening located below the threads;

a lid having a downwardly extending wall having inwardly directed threads configured to cooperate with the outwardly directed threads of the container to secure the lid relative to the container in a closed configuration;

and a locking mechanism connected to a first of the container and the lid, and at least one stop member provided with a second of the container and the lid, said locking mechanism having at least one engagement member; wherein the container assembly has a locked and an unlocked configuration, and when in the locked configuration, the at least one engagement member is prevented from rotation in a first direction with the at least one engagement member prevented from turning by engaging the at least stop member, and movement of the at least one engagement member a predetermined amount disengages the at least one engagement member from the at least one stop member thereby transitioning the container assembly to an unlocked configuration to allow rotation in the first direction, and a tamper indicator initially provided as connected to one of the container, lid and locking mechanism at a connection, and wherein in order to transition the lid to the unlocked configuration from the set configuration, the tamper indicator is at least partially broken to indicate a tampered condition and when in the tampered condition, the tamper indicator can be removed and replaced with a replacement tamper indicator by an authorized party to restore the container assembly to a set condition without replacing any one of the engagement member, the lid and the container, wherein the tamper indicator is connected to the locking mechanism with a prong extending through a bore in the locking mechanism.

2. The container assembly of claim 1 wherein the at least one stop further comprises at least one opening in a satellite ring located below the threads and the latch member is connected to the lid.

3. The container assembly of claim 1 wherein the locking mechanism further comprises a slide at least assisting in coupling the engagement member to an operator, and linear displacement of the slide with the operator transitions the locking mechanism from the locked to the unlocked configuration.

4. The container assembly of claim 3 wherein the tamper indicator is initially provided initially inhibiting access to at least the operator the engagement member until removed.

5. The container assembly of claim 1 wherein the engagement member is biased towards the locked configuration.

6. The container assembly of claim 1 wherein the prong has a barb preventing withdrawal of the prong from the locking mechanism once inserted.

7. The container assembly of claim 6 wherein the tamper indicator has a weakened portion between the barb and the shield which breaks to indicate tamper indication in the tampered condition, such shield preventing access to at least a portion of the locking member.

8. The container assembly of claim 1 wherein the tamper indicator provides a shield preventing access to at least a portion of the locking member.

9. The container assembly of claim 8 wherein the tamper indicator prevents access to an operator.

10. The container assembly of claim 9 wherein the tamper indicator is connected to the locking member.

11. The container assembly of claim 1 wherein the tamper indicator is automatically placed in the set condition when the container assembly is placed in the locked configuration.

12. A container assembly comprising:

a container having an open end and outwardly directed threads extending from an outer exterior wall surface of the container;

a lid having a downwardly extending wall having inwardly directed threads configured to cooperate with the outwardly directed threads of the container to secure the lid relative to the container in a closed configuration upon rotation in a second direction;

a locking mechanism operably coupled to one of the lid and the container, said locking mechanism having an engagement member; said container assembly having a locked and an unlocked configuration, the engagement member engaging at least one stop member of the container assembly in the locked configuration thereby preventing rotation in a first direction, and the engagement member not engaging at least one of the at least one stop member in the unlocked configuration allowing rotation in the first direction;

an operator operably coupled to the engagement member wherein movement of the operator a predetermined distance transitions the container assembly from the locked to the unlocked configuration thereby disengaging the engagement member from the stop member; and a first tamper indicator wherein when provided in a set configuration said first tamper indicator being at least partially broken to indicate at least one of an unlocked configuration and rotation of the engagement member past the stop member in the open direction for a triggered condition, said first tamper indicator provided initially connected to one of the lid container and latch assembly so that when turning in the second direction to the closed configuration the first tamper indicator is automatedly placed in the set configuration with the container assembly placed in the locked configuration, and once in the triggered condition, the first tamper indicator may be replaced with a second tamper indicator similar to the first tamper indicator as initially provided by an authorized party without replacing the lid, the container, any of the at least one stop, or the engagement member to restore the container assembly with the second tamper indicator to the set configuration, wherein the tamper indicator is connected to a locking mechanism with a prong extending through a bore in the locking mechanism.

13. The container assembly of claim 12 wherein the locking mechanism is connected to the downwardly extending wall of the lid.

14. The container assembly of claim 12 wherein the prong has a barb preventing withdrawal of the prong once inserted into the bore.

15. The container assembly of claim 14 further comprising a weakened portion between the barb and a shield of the tamper indicator, such shield preventing access to at least a portion of the locking member.

16. The container assembly of claim 12 wherein the tamper indicator further provides a shield preventing access to at least a portion of the locking member.

17. The container assembly of claim 16 wherein the tamper indicator prevents access to an operator.

18. The container assembly of claim 17 wherein the tamper indicator is connected to the locking member.

* * * * *